US005280822A

United States Patent [19]

Bullock

[11] Patent Number: 5,280,822

[45] Date of Patent: Jan. 25, 1994

[54] CASTING CORE FOR FORMING AN INTERCONNECTING CAMSHAFT GALLERY AND OIL GALLERY IN A CAST CYLINDER BLOCK

[75] Inventor: Chad A. Bullock, Bristol, Ind.

[73] Assignee: CMI International, Southfield, Mich.

[21] Appl. No.: 920,606

[22] Filed: Jul. 27, 1992

[51] Int. Cl.[5] ..... B22C 9/10

[52] U.S. Cl. ..... 164/369; 164/340; 164/365

[58] Field of Search ..... 164/339, 340, 9, 10, 164/11, 369, 365, 368, 137

[56] References Cited

U.S. PATENT DOCUMENTS

| | | | |
|---|---|---|---|
| 2,783,510 | 3/1957 | Dolza et al. | 164/368 |
| 2,991,520 | 7/1961 | Dalton . | |
| 3,374,827 | 3/1968 | Schebler | 164/137 |
| 3,945,429 | 3/1976 | Wahlqvist . | |
| 4,609,030 | 9/1986 | Heater et al. | 164/137 |
| 4,757,857 | 7/1988 | Henkel | 164/137 |
| 4,829,642 | 5/1989 | Thomas et al. . | |
| 4,981,168 | 1/1991 | Koch et al. | 164/339 |

FOREIGN PATENT DOCUMENTS

| | | | |
|---|---|---|---|
| 3543194 | 11/1986 | Fed. Rep. of Germany | 164/340 |
| 0117863 | 9/1981 | Japan | 164/340 |

*Primary Examiner*—Paula A. Bradley
*Assistant Examiner*—James Miner
*Attorney, Agent, or Firm*—Reising, Ethington, Barnard, Perry & Milton

[57] ABSTRACT

A sand casting core (102) for use in the manufacture of cast metal cylinder blocks includes a camshaft gallery-forming portion (108) and an interconnected oil gallery-forming portion (110) which is joined to the camshaft gallery-forming portion (108) via a plurality of transverse feeder passage-forming portions (112) extending therebetween for forming corresponding cast-in camshaft gallery (104) and interconnecting oil gallery (106) passages within a cast cylinder block (26).

11 Claims, 5 Drawing Sheets

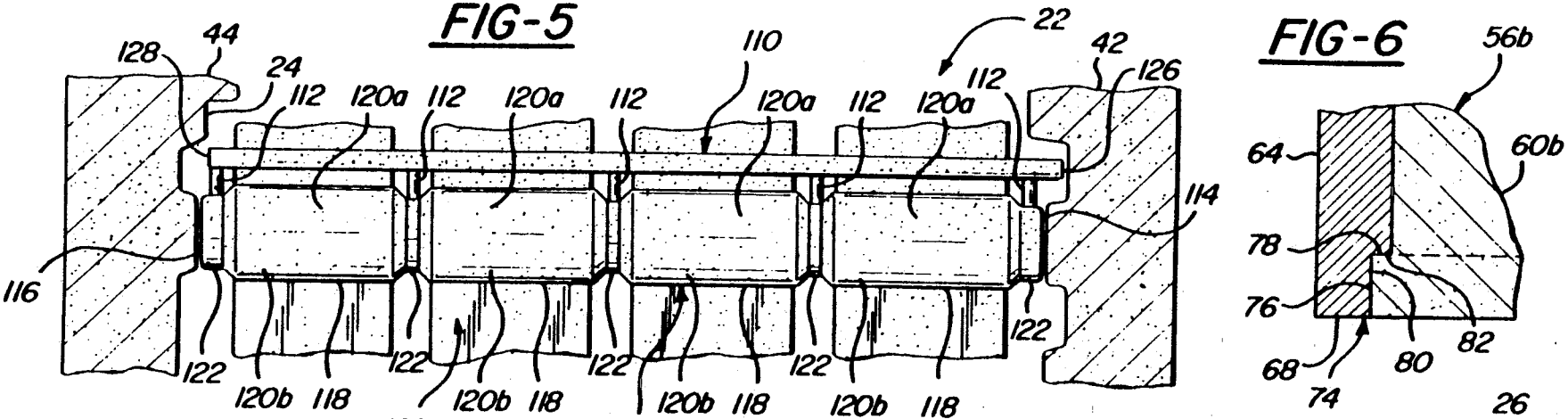
FIG-5
FIG-6
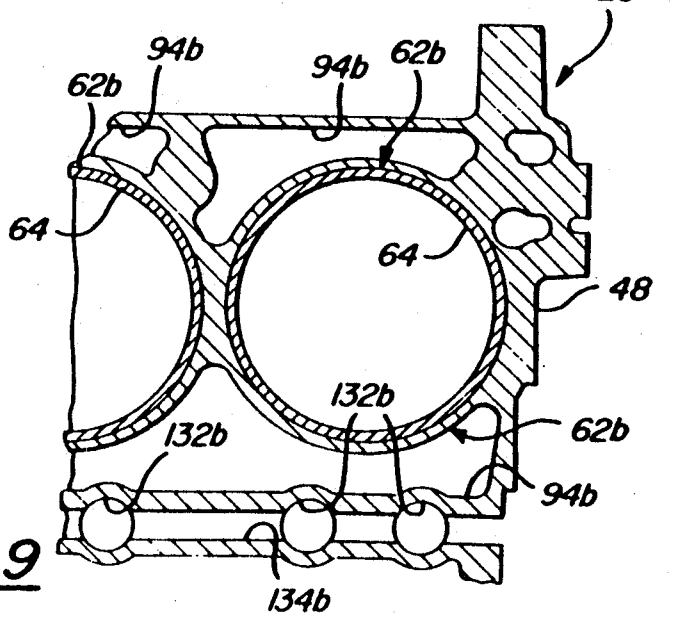
FIG-9
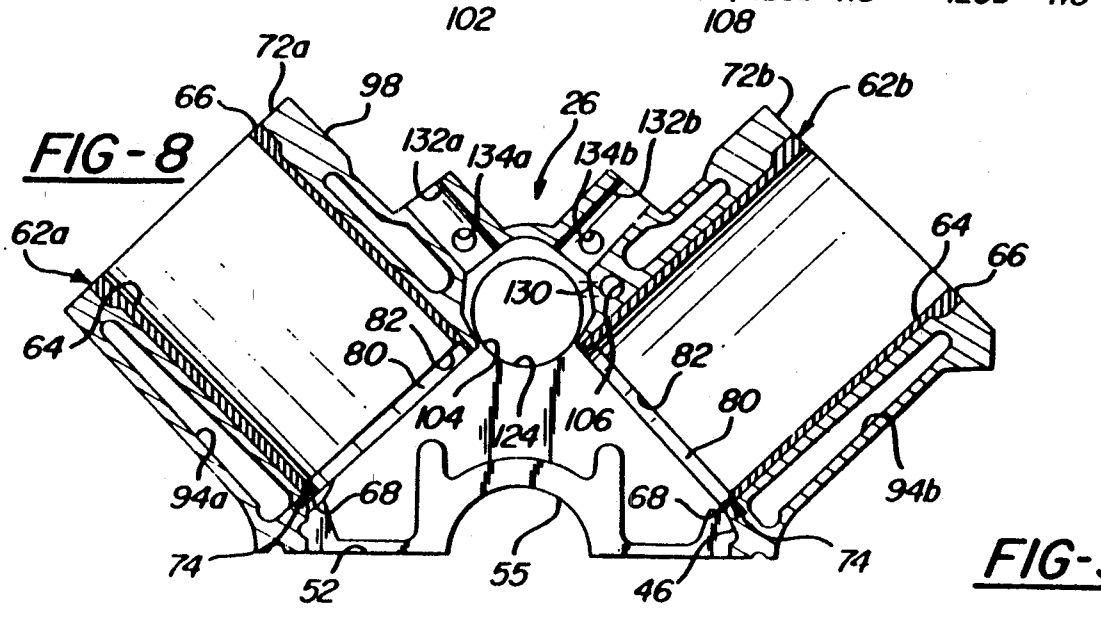
FIG-8

CASTING CORE FOR FORMING AN INTERCONNECTING CAMSHAFT GALLERY AND OIL GALLERY IN A CAST CYLINDER BLOCK

TECHNICAL FIELD

The present invention relates generally to casting cores for use in metal casting and more particularly to a refractory particulate-type core constructed so as to form a combined cast-in camshaft gallery and an associated gallery within a cast cylinder block of an internal combustion engine.

BACKGROUND OF THE INVENTION

It is known in the art to employ a refractory particulate-type casting core (e.g., a conventional sand foundry core) for forming an internal camshaft gallery within a cylinder block of an internal combustion engine cast within a mold. An example of such teaching is disclosed in the U.S. Pat. No. 2,783,510 to Dolza et al, granted Mar. 5, 1957. The camshaft gallery supports a camshaft of the engine for rotation within the cylinder block.

Accompanying the camshaft gallery in all known engines is one or more internal passageways for conducting lubricating oil to the rotating camshaft. Typically, these passageways take the form of a long and narrow oil gallery that extends along side the camshaft gallery and communicates therewith by a plurality of transverse feeder passages. With this type of system, the lubricating oil is introduced into the main oil gallery and then directed to various locations of the camshaft gallery of the feeder passages.

The known methods for forming such an oil gallery heretofore involve either drilling the gallery and feeder passages into the block or else casting the oil gallery in place during the manufacture of the block using specially designed cores and then drilling the feeder passages between the camshaft gallery and oil gallery. Both alternatives are costly and suffer from disadvantages as will be described below.

When drilling the oil gallery into the block, it is often necessary to drill the gallery from both ends. This double ended drilling process is necessary since the oil gallery extends virtually the entire length of the block and can not be practically formed by drilling from one end since the drilling tool has a tendency to wonder as it is extended further and further into the block. Double drilling adds to the cost of complexity of manufacturing the cylinder block. Another disadvantage is that the oil gallery passage is open at both ends of the block, thereby requiring one end be subsequently plugged. Such plugs are troublesome and over time have a tendency to loosen and leak.

Known specially manufactured cores include those disclosed in U.S. Pat. No. 2,991,520 to Dalton, granted Jul. 11, 1961; U.S. Pat. No. 3,945,429 to Wahlqvist, granted Mar. 23, 1976; and U.S. Pat. No. 4,829,642 to Thomas et al, granted May 16, 1989. The core of Thomas is of a cast-in stainless steel tube-type which remains in place with the cylinder block following casting. Such tubes, however, are problematic and that steps must be taken to assure that the outer surface is clean and free from any debris that would form imperfections in the casting or prevent good metal lay-up between the outside of the tube and the cylinder block metal. Such tubes thus add additional cost and complexity to the manufacturer of a cylinder block.

The Dalton and Wahlqvist cores are formed with a metal central support element surrounded by a sheath of refractory material, such as woven glass or particulate sand. These passageway cores are printed into the cavity walls of the mold so as to form a through-passage in both ends of the block, as with drilling, for supporting the cores in the mold cavity and accommodating removal of the cores following casting. These nonconventional cores add to the cost of manufacturing a block and have not enjoyed great commercial success. One open end of the through-passage also has to be plugged, as described previously with reference to drilled oil gallery passages and thus suffers from the same disadvantages.

Accordingly, there is a need in the industry for a suitable casting core for forming a long and narrow gallery passage within a cylinder block.

SUMMARY OF THE INVENTION AND ADVANTAGES

A foundary core construction for use in the manufacture of a cast metal cylinder block for an internal combustion engine comprises: a one-piece foundary core fabricated of reducible refractory material including a camshaft gallery-forming portion and an integral oil gallery-forming portion for disposition within a casting cavity of a cylinder block casting mold for forming an associated camshaft gallery and an interconnecting oil gallery within a cylinder block cast within the mold.

A casting mold assembly is also contemplated having the novel foundary core incorporated therein.

The inventive casting core advantageously combines a camshaft gallery-forming portion with an interconnecting oil gallery-forming portion in a single refractory particulate casting core using conventional decomposable refractory core material. The camshaft-forming portion provides support to the smaller oil gallery-forming portion along its length enabling the long and slender oil gallery-forming portion to be fabricated of conventional refractory particulate material.

The present invention reduces the cost and complexity of manufacturing cylinder blocks.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is a fragmentary cross-sectional view of the mold assembly showing the combined camshaft gallery/oil gallery casting core supported within the mold cavity;

FIG. 6 is an enlarged fragmentary cross-sectional view showing the mechanical interlock between the piston chamber core and the liner member;

FIG. 8 is a cross-sectional view taken along lines 8—8 of FIG. 7; and FIG. 9 is a fragmentary cross-sectional view of the cylinder block showing the intersecting oil gallery and push rod passages.

DETAILED DESCRIPTION OF THE DRAWINGS

Figure 7:
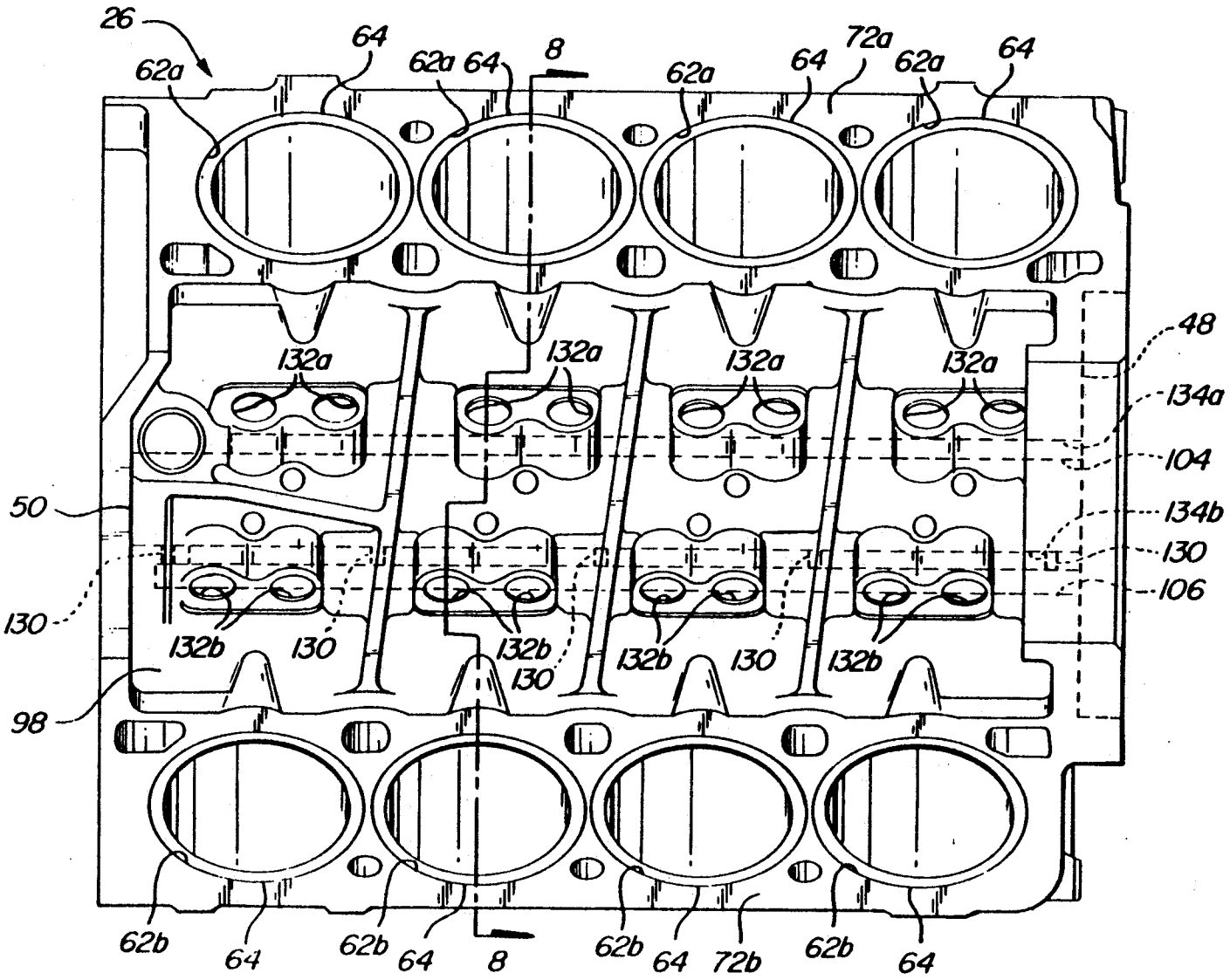
FIG. 7 is a top view of the cylinder block.

A mold assembly constructed according to a preferred embodiment of the invention is comprised of a multiplicity of sand-type foundry cores (i.e., formed from particulate foundry sand and a suitable binder) constructed and arranged so as to form a cylinder block casting mold 22 having inner walls of which define a contoured cavity 24 for receiving molten casting metal and shaping the metal to form a cylinder block for an internal combustion engine, generally indicated at 26 in FIGS. 7–9. The casting metal is preferably aluminum.

Figure 1:
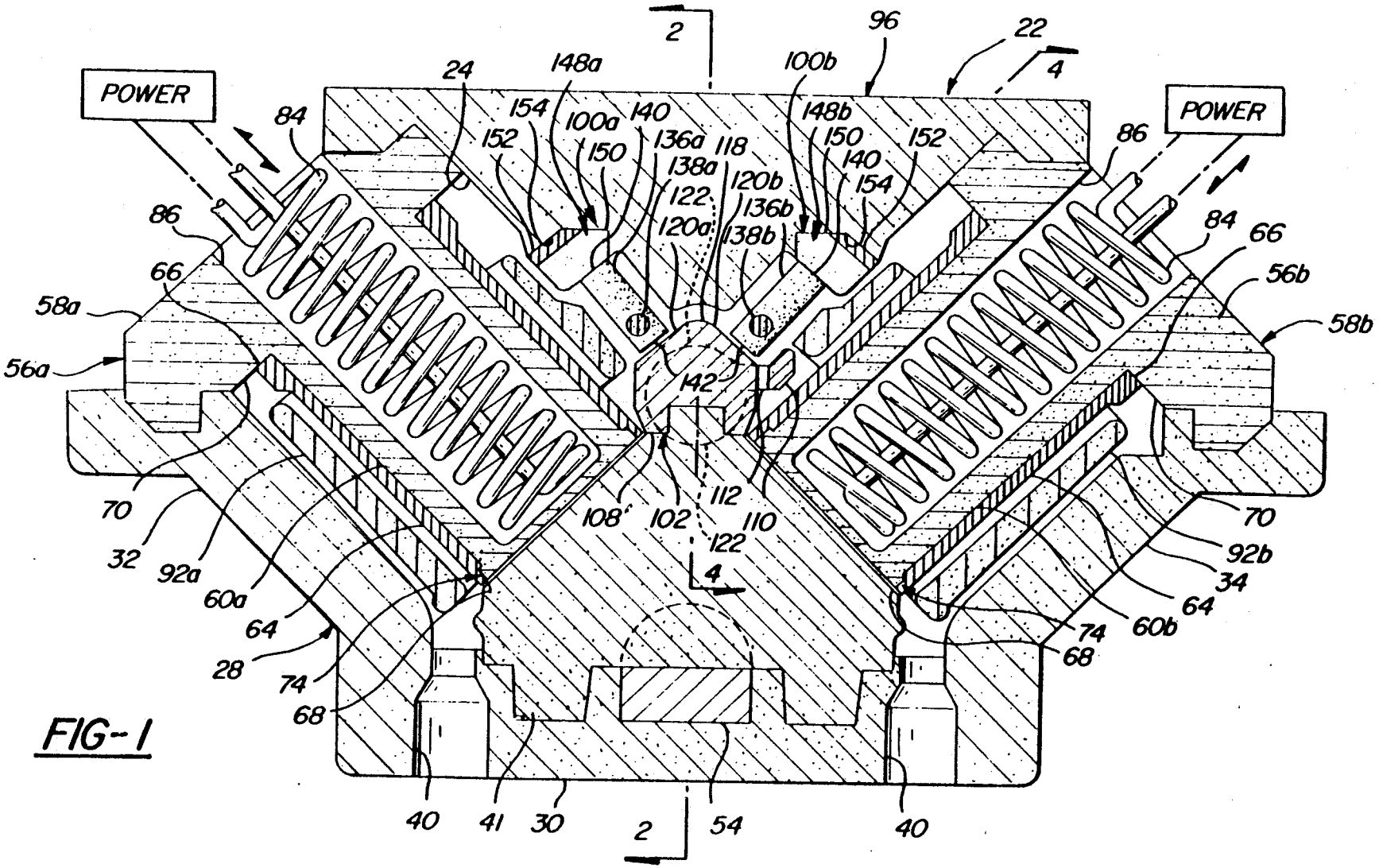
FIG. 1 is a cross-sectional view of the mold assembly.
Figure 2:
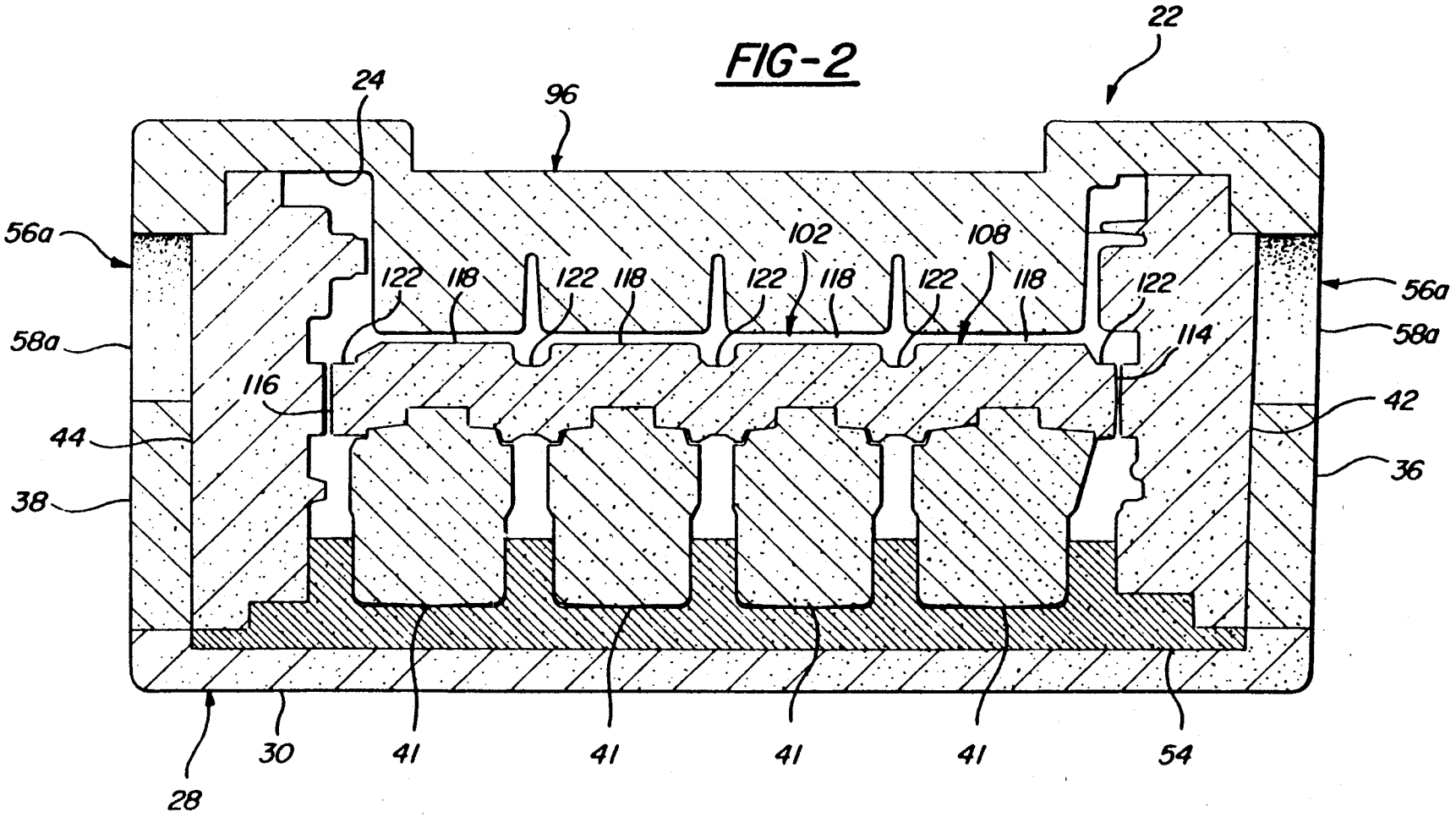
FIG. 2 is a view taken along lines 2—2 of FIG. 1.

The coring arrangement includes a dish-shaped base core 28 having a generally planar bottom portion 30 and opposed left and right upstanding side walls 32, 34 (as viewed in FIG. 1) and front and rear end walls 36, 38 (as viewed in FIG. 2). The bottom portion 30 is formed with a plurality of inlets 40 extending into the cavity 24 for admitting the molten metal into the cavity 24 and filling the cavity 24 from the bottom up.

Supported by the bottom portion 30 of the base core 28 are four spaced apart generally triangular-shaped crankcase cores 41 and a pair of opposed front and rear end face cores 42, 44 for forming within the block 26 a crankcase cavity 46 partitioned into four separate chambers by front and rear end face walls 48, 50 and three intermediate web-like bulkhead walls 52 (only one shown in FIG. 8). The bottom portion 30 of the base core 38 also supports a metal bulkhead chill 54 extending between the end face cores 42, 44, and presenting a semi-circular shape-imparting surface to the cavity 24 for forming correspondingly shaped crankshaft bearing seats 55 in each of the end face walls 48, 50 and intermediate bulkheads 52.

Also included in the coring arrangement is a pair of opposed left and right piston cylinder-forming cores **56*a*, 56*b*. The cores 56*a*, 56*b* are each formed with a base portion 58*a*, 58*b* for mounting the cores 56*a*, 56*b* to the side walls 32, 34 (FIG. 1) and end walls 36, 38 (FIG. 2) of core 28, and four generally cylindrical barrel-shaped main body portions 60*a*, 60*b* which depend downwardly and inwardly toward one another from their respective base portions 58*a*, 58*b* into the mold cavity 24 in a preferred 90° V-type angular arrangement for forming correspondingly arranged left and right banks of piston cylinder chambers 62*a*, 62*b* within the cylinder block 26 (FIGS. 7 and 8**).

As shown best in FIG. 1, the free ends of the main body portions **60*a*, 60*b* are supported adjacent the crankcase cores 40 and are preferably spaced slightly therefrom such that the main body portions 58*a*, 58*b* are suspended in the cavity 24 by the base 28. The small space between the crankcase cores 40 and main body portions 60*a*, 60*b* compensates for manufacturing tolerances associated with the various cores and produces a thin film-like flash of solidified casing metal between the crankcase cavity 46 and cylinder chambers 62*a*, 62*b* in the resultant cast cylinder block 26. This flash is removed in a subsequent bore operation following casting to establish communication between the cylinder bores 62*a*, 62*b* and the crankcase cavity 46**.

Each of the main body portions **60*a*, 60*b* has a sleeve-like metal tubular liner member 64 disposed thereabout with the outer surface of the liner members 64 exposed to the cavity 24 for cast-in-place joinder and attachment to the cylinder block casting metal for lining the piston cylinder chambers 62*a*, 62*b* with the liner members 64. The liner members 64** are preferably made from metal material exhibiting good wear properties at high temperatures, such as cast iron, steel, and high silicon content aluminum.

As also shown best in FIG. 1, the liners 64 have solid continuous walls (i.e., do not have any passages or holes extending through the sidewalls) extending between upper and lower ends 66, 68 thereof with the upper ends 66 abutting an inner cavity wall surface 70 of their respective base portions **58*a*, 58*b*. The surface 70 forms a corresponding left and right upper deck 72*a*, 72*b* of the respective left and right banks of piston cylinder chambers 62*a*, 62*b*** to which an associated pair of cylinder heads (not shown) of the engine are mounted.

The piston cylinder chamber-forming cores **56*a*, 56*b* are also provided with mechanical interlocking means 74 formed between the ends 66, 68 of the liner members 64 and wholly within the confines of the walls of the liner members 64 for axially interlocking each liner member 64 with its respective barrel-shaped main body portion 60*a*, 60*b* to prevent the liner members 64 from sliding axially on the main body portions 60*a*, 60*b***.

The mechanical interlocking means 74 is shown best in FIG. 6 and comprises an annular ring-like projection 76 formed preferably at the free ends of the main body portions **60*a*, 60*b* and extending radially outwardly therefrom to define the shoulder 78 facing toward the respective base portion 58*a*, 58*b* of the core 56*a*, 56*b*. The inner wall surface of each liner member 64 is likewise formed with a cooperating annular ring-like recess 80 formed adjacent the lower end 68 and receiving an associated one of the projections 76 therein. Each recess 80 presents a shoulder 82 facing oppositely the shoulders 78 of the projections 76. The shoulders 78, 82 abut one another to prevent the liner members 64 from sliding downwardly on the main body portions 60 into the cavity 24. In this manner, each liner member 64 is tightly locked against axial movement in either direction on the main body portions 60*a*, 60*b* by the combination of the abutting shoulders 78, 82 on the lower end and the abutting engagement between the upper ends of the liners 66 and the inner surface of the base portion 70**.

In order to form the mechanical interlock 74 between the liners 64 and piston cylinder chamber-forming cores **56*a*, 56*b*, the cores 56*a*, 56*b* are formed in-situ (i.e., in place) with the liner members 64. This process involves first machining the annular ring-like recess 80 into the inner wall surface of the liner members 64 adjacent the lower end 68 and disposing the liner members 64 within a cavity of a core box (not shown). A refractory particulate material/binder core mixture is then introduced into the core box cavity and against the inner surface of the liner member 64 so as to fill the recess 80 with a projection 76 and allowed to cure to form the interlock 74. The core/liner assembly 56*a*, or 56*b* is then removed from the core box for use in making the casting mold 22**. The core mixture may be introduced into the core box by any of a number of well known methods including compaction or blowing.

Following casting of the cylinder block 26, the inner surface of the liner members 64 are machined to manufacturers specifications at which time the recesses 80 are removed so as to not interfere with the operation of the engine.

The piston cylinder chamber-forming cores **56*a*, 56*b* are further provided with heating means 84 disposed within the main body portions 60*a*, 60*b* for heating the liner members 64. The heating means 84 preferably includes induction coil type heaters 84 as shown in the drawings but may include other types of heating devices known to the art. The induction heaters 84 are preferably disposed in associated central blind recesses 86 of the cores 56***a*, 56*b* which are open at the top to the outside of the mold 22 and extend therefrom down into each of the main body portions 60*a*, 60*b* to within the confines of the liner members 64 as shown in FIG. 1. The heaters 84 are preferably separable from the cores 56*a*, 56*b* enabling the heaters 84 to be inserted into the blind recesses 86 during casting to heat the liners 64 and, following casting, being retractable out of the recesses 86 for subsequent reuse with other casting molds. In other words, the heaters 84 are supported in such a way as to enable them to be selectively inserted and withdrawn from their associated recesses 86.

The heaters 84 are preferably used to preheat the liners 64 prior to casting. This preheating of the liners 64 promotes good lay up and cohesion of the molten metal and liners 64. Heating with induction type heaters 84 causes the liner 64 to be heated, but, because the insulating properties of the refractory piston cylinder chamber-forming cores 56*a*, 56*b*, the cores 56*a*, 56*b* are relatively unaffected by induction heating (except, of course, for a small amount of conductive heat gained by contact with the surrounding liners 64). Because of the relative differences in heating, the liners 64 are caused to expand relative to the main body portions 60*a*, 60*b*. That is, the inner diameter of the liner members 64 increases relative to the outer diameter of the main body portion 60*a*, 60*b*. The interlock 74 provides a means for accommodating the relative changes in diameter between the liners 64 and main body portions 60*a*, 60*b* and preventing the liners 64 from sliding downwardly on the main body portions 60*a*, 60*b* out of their proper position. It has been found that forming the recess 80 to a depth of about 0.020 inches is sufficient to accommodate the growth of the liner 64 while retaining a mechanical interlock with the projections 76 to prevent slippage. It will be understood, however, that the depth of the recess 80 may be larger or smaller than 0.020 inches, depending on the particular application.

The coring arrangement also includes a pair of left and right water jacket cores 92*a*, 92*b* (FIG. 1) which are disposed about and spaced from the liner members 64 for forming corresponding left and right water jacket chambers 94*a*, 94*b* around the liner members 64 and through which water is circulated to cool the piston cylinder chambers during operation of the engine.

Also included in the coring arrangement is an upper valley core 96 of generally triangular transverse cross-sectional shape (FIG. 1). The valley core 96 is sealingly joined, such as by cementing, to the base portions 58*a*, 58*b* of the piston cylinder chamber-forming core 56*a*, 56*b* along respective left and right side edges of the core 96 and at its ends to the front and rear end face cores 42, 44 for forming a corresponding V-shaped valley 98 between the left and right banks of piston cylinder chambers 62*a*.

Included also among the various cores are a left and right pair of combined push rod passage/oil gallery-forming cores 100*a*, 100*b* mounted to the valley core 96 and a combined camshaft gallery/oil gallery-forming core 102 mounted to the top of the crankcase cores 40 within the cavity 24.

The combined push rod passage/oil gallery-forming cores 100*a*, 100*b* and camshaft gallery/oil gallery-forming core 102 are formed of a reducible refractory material which is resistant to the molten casting metal yet is reducible following casting to leave galleries and passages formed thereby open and unimpeded. In a preferred construction, these cores 100*a*, 100*b*, 102 are formed of particulate foundry sand united with a suitable decomposable binder, such as a curable resin, as are the other cores described above. The cores 100, 102 are also made according to traditional foundry core practice, like the other cores.

The camshaft gallery/oil gallery-forming core 102 is unique in that it is a one-piece core having means or portions thereof for forming a camshaft gallery 104 and an associated interconnecting oil gallery 106 within the cylinder block 26 as a result of casting the block 26 within the mold 22. That is, the core 102 is of one integral piece formed entirely out of the same sand core-type material and has a camshaft gallery-forming portion 108 and an associated oil gallery-forming portion 110 which is joined integrally to the camshaft gallery-forming portion 108 by a plurality of transverse integral feeder passage-forming portions 112.

The camshaft gallery-forming portion 108 extends between opposite front and rear ends 114, 116 and along a central linear axis thereof. The core 102 is supported lengthwise within the cavity 24 by the crankcase cores 40 such that the front and rear ends 114, 116 of the camshaft gallery-forming portion 108 are disposed adjacent the associated front and rear end face cores 42, 44 and preferably spaced slightly therefrom to accommodate design tolerances resulting in the formation of a flash of solidified cylinder block metal covering the open ends of the camshaft gallery 104, which flash is subsequently removed in a machining operation following casting.

The camshaft gallery-forming portion 108 includes four enlarged portions 118 presenting left and right flat faces 120*a*, 120*b* oriented preferably 90° apart and perpendicular to the central axes of the respective left and right main body portions 60*a*, 60*b*. Formed at the ends 114, 116 of the camshaft gallery-forming portion 108 and also interjacent the enlarged regions 118 are annular reduced diameter or constricted regions 122 that form corresponding annular openings or holes 124 in the end walls 48, 50 and bulkheads 52 (FIG. 8) which define annular bearing surfaces for journaling a camshaft (not shown).

The oil gallery-forming portion 110 of core 102 extends between opposite front and rear ends 126, 128 along a central linear axis thereof parallel to that of the camshaft gallery-forming portion 108. The oil-gallery forming portion 110 is spaced from the camshaft gallery-forming portion 108, as shown in FIG. 5, with the transverse feeder-forming portions 112 extending perpendicularly between an interconnecting (i.e., bridging) the camshaft gallery-forming portion 108 and oil gallery-forming portion 110 at preselected locations along the length thereof. The feeder passage-forming portions 112 form interconnecting fluid passageways 130 (FIG. 8) between the oil gallery 106 and camshaft gallery 104.

Preferably, the feeder passage-forming portions 112 connect the constricted regions 122 of the camshaft gallery-forming portion 108 and the oil gallery-forming portion 110 such that the annular bearing surfaces 124 are fluidly coupled to the oil gallery 106 via the feeder passages 130. The oil gallery-forming portion 110 is supported in the cavity 124 with its front end 126 closely adjacent the front end face core 42 so as to form essentially a through-passage in the front end face wall 48 of the block 26 for admitting lubricating oil into the oil gallery 106. The front end 126 is, however, slightly spaced from the front end face core 42 (FIG. 5) for accommodating design tolerances such that a thin film-like flash of casting metal is formed across the through-hole opening into the oil gallery 106. The flash is likewise removed in a subsequent machining operation following casting. It will be understood, however, the front end 126 could be disposed so as to engage the front end face core 42 and form a cast-in through-hole into the oil gallery 106.

The rear end 128 of the oil gallery-forming portion 110 is spaced significantly further from its associated rear end face core 44 than the opposite front end 126 so as to purposely avoid forming a through-hole in the rear end face wall 50 of the block 26. In this manner, the gallery 106 comprises a blind passage extending into the block 26 through the front end face wall 46 and terminating short of passing through the rear end face wall 50. This blind oil gallery 106 advantageously avoids having to close off one end of the oil gallery with the plug or other insert following casting. As also shown in FIG. 5, the front end 126 of the oil gallery-forming portion 110 extends beyond a closest-adjacent one of the feeder passage-forming portions 112 in cantilever fashion so as to be disposed adjacent the front end face core 42 in the aforementioned described manner. Also, the rear end 128 of the oil gallery-forming portion 110 terminates at and is joined with another of the feeder passage-forming portions 112 associated therewith so as to be spaced from the adjacent rear end face core 44 in the aforementioned described manner.

Although the oil gallery-forming portion 110 may take on any of a number of various cross sectional shapes (including circular), the preferred shape rhomboidal.

Figure 3:
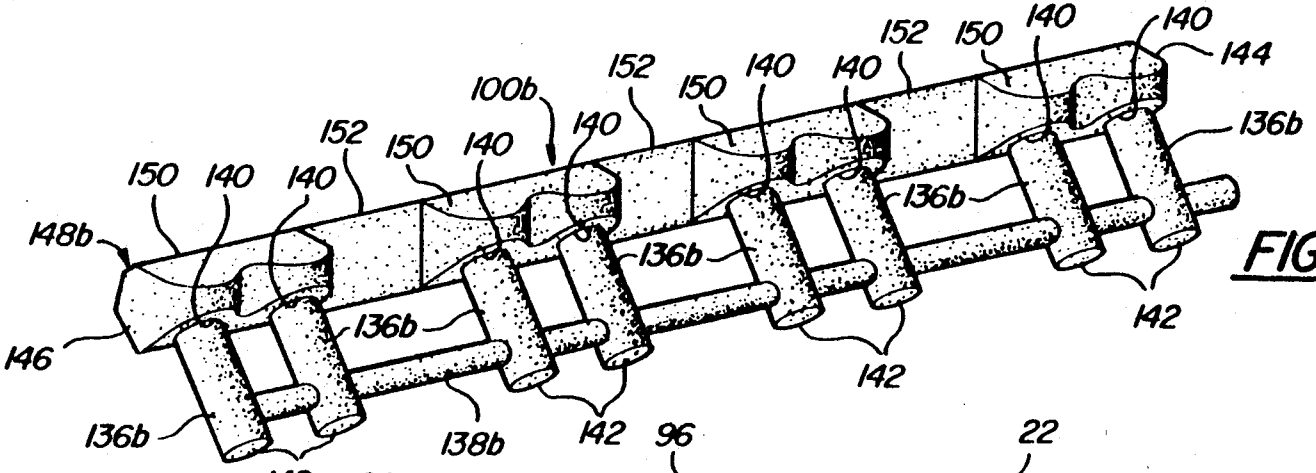
FIG. 3 is an isometric view of a combined push rod passage/oil gallery casting core of the invention.

The combined push rod passage/oil gallery-forming cores 100*a*, 100*b* are unique in that they are each a one-piece core provided with means or portions thereof for forming a left and right plurality of spaced apart push rod passages 132*a*, 132*b* in the block 26 as well as associated transverse intersecting left and right oil galleries 134*a*, 134*b*. In other words, the left and right cores 100*a*, 100*b* each include a plurality of push rod passage-forming portions 136*a*, 136*b* for forming the push rod passages 132*a*, 132*b*, respectively, of the block 26 and an integral intersecting transverse oil gallery-forming portion 138*a*, 138*b* for forming the left and right oil galleries 134*a*, 134*b* of the block 26. As best shown in FIG. 3, each core 100*a*, 100*b* includes eight such push rod passage-forming portions 136*a*, 136*b* of generally cylindrical shape and extending along respective central axes between a connected end 140 and a distal free end 142.

The oil gallery forming portions 138*a*, 138*b* is likewise cylindrical in shape and extends along a respective central linear axis thereof between oppositely disposed front 144 and rear 146 ends thereof. The push rod passage-forming portions 136*a*, 136*b* are arranged in-line along the length of their associated oil gallery-forming portion 138*a*, 138*b* with the central axes of the push rod passage-forming portions 136*a*, 136*b* sharing a common plane. The oil gallery-forming portion 138*a*, 138*b*, intersects each of the respective push rod passage-forming portions 136*a*, 136*b* intermediate the ends 144, 146 thereof and with the central axis of the oil gallery-forming portion 138*a*, 138*b* interesting the respective central axes of the push rod passage-forming portions 136*a*, 136*b*.

As also shown in FIG. 3, the push rod passage-forming portions 136*a*, 136*b* are spaced from one another and arranged in pairs of two such that the spacing between adjacent paired push rod forming portions is closer than the spacing between adjacent nonpaired portions.

By combining the push rod passage-forming portions 136*a*, 136*b* integrally with the oil gallery-forming portion 138*a*, 138*b*, the oil gallery-forming portion 138*a*, 138*b* is supported at numerous locations along its length by the push rod passage-forming portion 136*a*, 136*b*. This support enables the relatively long and narrow oil gallery-forming portion 136*a*, 136*b* to be constructed from conventional decomposable refractory material of the type described above. As a rule of thumb in the industry, if an application calls for a core having an unsupported length-to-diameter ratio that exceeds about 10–15, then alternatives to conventional foundry sand-type cores must be considered since a sand core of such a configuration would be much too brittle and susceptible to damage during handling and casting. As such, it has been thought heretofore not possible to form the oil galleries 134*a*, 134*b* for the push rod passages nor the oil gallery 106 for the camshaft gallery 104 entirely out of conventional foundry sand since the overall end-to-end length of such a core typically exceeds the acceptable upper limit. For instance, the oil gallery-forming portions 138*a*, 138*b* have a diameter of about ½ inch and an overall end-to-end length approaching 18 inches. If supported only at its ends within the casting cavity 24, it would have an unsupported length to diameter ratio of about 36 and would be unsuitable as a convention foundry sand core. However, when combined with the push rod forming portions 136*a*, 136*b*, the same oil gallery-forming portion 138*a*, 138*b* is now supported at numerous locations along its length with the greatest unsupported length being about 3 inches between adjacent nonpaired push rod forming portions and the unsupported length between adjacent paired push rod-forming portions being approximately 1.5 inches. As such, the oil gallery-forming portion now has a greatest unsupported length to diameter ratio of approximately 6 (well below the practical limit).

Each core 100*a*, 100*b* is formed with a core print projection 148*a*, 148*b* formed on the connected end 140 of the push rod passage-forming portions 136*a*, 136*b* for mounting the cores 100*a*, 100*b* for support within the mold cavity 24, as shown in FIG. 1. The core print projections 148*a*, 148*b* are preferably continuous and join each connected end 140 of the push rod passage-forming portions 146*a*, 146*b* together (i.e., are integral therewith) for adding strength and rigidity to the cores 100*a*, 100*b*. The projections 148*a*, 148*b* include enlarged portions 150 that are joined directly with the connected ends 140 and thin web-like connecting portions 152 extending between and joining the enlarged portions 150.

Figure 4:
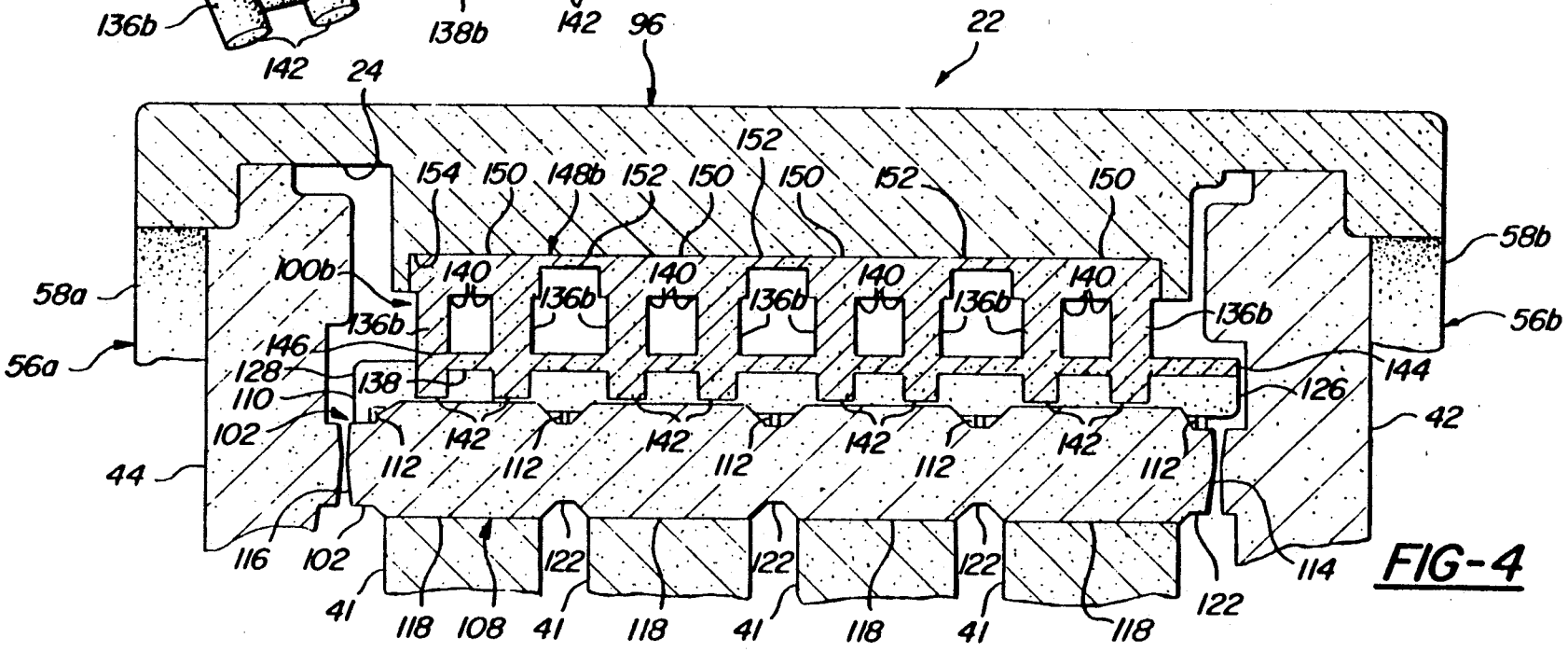
FIG. 4 is a fragmentary cross-sectional view of the casting mold assembly taken along lines 4—4 of FIG. 1.

As shown in FIGS. 1 and 4, the cores 100*a*, 100*b* are suspended lengthwise in the mold cavity 24 by the valley core 96. The valley core 96 is formed with a pair of left and right core print depressions 154*a*, 154*b* in which are received the associated core print projections 148*a*, 148*b*. The depressions 154*a*, 154*b* orient the left and right push rod passage-forming portions 136*a*, 136*b* in the same preferred 90° V-manner as the piston cylinder chamber-forming cores 56*a*, 56*b* and with the axes of the left and right push rod passage-forming portions 136*a*, 136*b* intersecting a central transverse axis of the camshaft gallery/oil gallery-forming core 102 (FIG. 1).

The distal free ends 142 of the push rod-forming portions 136*a*, 136*b* are disposed closely adjacent the associated left and right flat faces 120*a*, 120*b* of the oil gallery-forming portion 110 of core 108. As such, the push rod passages 132*a*, 132*b* are formed as essentially through passages extending between the valley 98 of the block 26 and the camshaft gallery 104 but, because of the slight spacing, have a thin film-like flash of casting metal formed across the passages 132*a*, 132*b* to the camshaft gallery 104. The flash is similarly removed following casting. The push rod passages 132*a*, 132*b* accommodate the engines push rods and tappets (not shown) which communicate with the camshaft (not shown) to operate intake and exhaust valves (not shown) associated with each piston cylinder chamber 62*a*, 62*b*.

The front end 144 of the oil gallery-forming portions 138*a*, 138*b* extends beyond the closest adjacent push rod passage-forming portion in cantilever fashion, as shown in FIG. 4, and is positioned closely adjacent the front end face core 42 for forming an essentially a through-passage in the front end face wall 48 of the block 26. However, as with the oil gallery-forming portion 110, the front ends 144 are slightly spaced from the front end face core 42 and form a thin film-like flash of casting metal across the opening. This flash is also removed in a machining operation following casting. The rear ends 146 of the oil gallery-forming portions 138*a*, 138*b* are disposed adjacent the rear end face 44 but spaced a greater distance therefrom so as to intentionally avoid the formation of a through-hole in the rear end face wall 50 of the casting 26. As such, the left and right oil galleries 134*a*, 134*b* are formed as blind passages. As shown in FIG. 4, the rear ends 146 of the oil gallery-forming portions 138*a*, 138*b* terminate at and are joined with an push rod passage-forming portion 136*a*, 136*b*.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A foundry core construction for use in manufacturing a cast cylinder block of an internal combustion engine, said core construction comprising;

a one-piece foundry core (102) fabricated of reducible refractory material including a camshaft gallery-forming portion (108) and an integral oil gallery-forming portion (110) for disposition within a casting cavity of a cylinder block casting mold, said camshaft gallery-forming portion (108) including a plurality of transverse feeder passage-forming portions (112) extending between and interconnecting said camshaft gallery-forming portion (108) and said oil gallery-forming portion (110) at preselected locations along the lengths thereof for forming an associated cast-in camshaft gallery (104) and interconnecting oil gallery (106) within a cylinder block cast in the mold.

2. A core construction according to claim 1 further characterized by said reducible refractory material comprising particulate foundry sand and a binder.

3. A core construction according to claim 1 further characterized by said camshaft gallery-forming portion (108) having a plurality of annular constricted regions (122) for forming a corresponding plurality of annular bearing surfaces (124) within the block (26), said feeder passage-forming portions (112) extending between said constricted regions (122) and said oil gallery-forming portion (110).

4. A core construction according to claim 3 further characterized by one end of said oil gallery-forming portion (110) extending beyond a closest-adjacent one of said feeder passage-forming portions (112) in cantilever fashion and an opposite end of said oil gallery-forming portion (110) terminating at and joined with an associated another of said feeder passage-forming portions (112).

5. A core construction according to claim 2 further characterized by said oil gallery-forming portion (110) having a rhomboidal cross-sectional shape.

6. A casting mold assembly for use in the manufacture of a cast metal cylinder block for an internal combustion engine, said assembly comprising:

a cylinder block casting mold (22) having a cavity (24) therein for receiving molten casting metal;

and characterized by a casting core (102) disposed within said mold cavity (24) and formed of reducible refractory material including a camshaft gallery-forming portion (108) and in integral oil gallery-forming portion (110) disposed within said cavity (24), said camshaft gallery-forming portion (108) including a plurality of transverse feeder passage-forming portions (112) extending between and interconnecting said camshaft gallery-forming portion (108) and said oil gallery-forming portion (110) at preselected locations along the lengths thereof for forming a camshaft gallery (104) and an interconnecting oil gallery (106) within a cylinder block (26) cast within said mold (22).

7. An assembly as set forth in claim 6 further characterized by said reducible refractory material comprising particulate foundary sand and a binder.

8. An assembly as set forth in claim 6 further characterized by said camshaft gallery-forming portion (108) having a plurality of annular constricted regions (122) for forming a corresponding plurality of annular bearing surfaces (124) within the block (26), said feeder passage-forming portions (112) extending between said constricted regions (122) and said oil gallery-forming portion (110).

9. An assembly as set forth in claim 8 further characterized by one end of said oil gallery-forming portion extending beyond a closest-adjacent one of said feeder passage-forming portions (112) in cantilevered fashion and the opposite end of said oil gallery-forming portion (110) terminating at and joined with an associated another of said feeder passage-forming portions (112).

10. An assembly as set forth in claim 9 further characterized by at least one of said ends of said oil gallery-forming portion (110) being spaced from said inner wall of said cavity (24).

11. An assembly as set forth in claim 6 further characterized by said oil gallery-forming portion (110) having a rhomboidal cross-sectional shape.

* * * * *